United States Patent [19]

Ingram et al.

[11] 4,301,752

[45] Nov. 24, 1981

[54] TUFTING APPARATUS FOR FORMING LOOP PILE

[75] Inventors: Gary L. Ingram, Ooltewah; Paul E. Jolley, Chattanooga, both of Tenn.

[73] Assignee: Spencer Wright Industries, Inc., Chattanooga, Tenn.

[21] Appl. No.: 174,119

[22] Filed: Jul. 31, 1980

[51] Int. Cl.[3] ..... D05C 15/36

[52] U.S. Cl. ..... 112/79 R

[58] Field of Search ..... 112/79 R, 79 A, 410, 112/411, 266.2

[56] References Cited

U.S. PATENT DOCUMENTS

| | | | |
|---|---|---|---|
| 3,084,645 | 4/1963 | Card | 112/79 R |
| 3,919,953 | 11/1975 | Card et al. | 112/79 R |
| 4,134,347 | 1/1979 | Jolley et al. | 112/79 A |
| 4,138,956 | 2/1979 | Parsons | 112/79 R |
| 4,185,569 | 12/1979 | Inman | 112/79 R |

*Primary Examiner*—H. Hampton Hunter
*Attorney, Agent, or Firm*—Alan Ruderman

[57] ABSTRACT

A cut pile tufting machine having cut pile hooks and cooperating knives pointing in the direction oppositely to the direction in which a base fabric is being fed includes loop pile loopers in a selective array in the same mounting bar as the cut pile hooks and also pointing in the direction oppositely to that in which the fabric is being fed. The loop pile loopers each include a yarn seizing beak having a slightly downwardly inclined rearwardly extending bottom front edge at the rear of which a yarn contacting edge extends abruptly downwardly. The yarn contacting edge engages the crotch of a loop presented by a cooperating needle as the beak enters the loop allowing the loop to be seized and then shed by the beak. The looper includes a recess in the body behind the yarn contacting edge to provide a clearance with respect to the needle eye as the beak enters the clearance above the needle eye.

5 Claims, 4 Drawing Figures

TUFTING APPARATUS FOR FORMING LOOP PILE

BACKGROUND OF THE INVENTION

This invention relates to tufting machines and more particularly to tufting apparatus for forming selective rows of loop pile stitching in a cut pile tufting machine.

In a tufting machine a plurality of rows of yarn carrying needles are reciprocably driven through a base fabric fed through the machine to form loops to be seized by loopers oscillating below the fabric in timed relationship with the needles as the loopers cross the needles just above the needle eye. In loop pile machines the loopers point in the direction in which the base fabric is being fed, and hold the seized loops while the needles are being retracted from the fabric, thereafter moving away from the point of seizure to release the loop. In cut pile machines the loopers point in the direction opposite to the direction of fabric feed so the loops feed into the loopers and each looper cooperates with a respective oscillating knife. Since the loops are being fed toward the closed end of the looper they cannot be released except by being cut by the knife. As the looper rocks away from the point of loop seizure the knife rocks upwardly and cuts the loop between the top edge of the knife and the bottom edge of the looper.

It is known to form spaced rows of cut pile and loop pile in a tufting machine by a number of methods. For example, in Card U.S. Pat. No. 3,084,645 cut pile and loop pile in the same row of stitching can be formed selectively using a looper pointing in the direction oppositely to fabric feed, the looper having a spring clip which permits a loop to be withdrawn from the looper by backdrawing yarn to force the clip away from the looper. The loops withdrawn remain uncut while those loops that remain on the looper are cut. A yarn feed pattern attachment must be utilized to effect selectively the backdrawing. Thus, although each row of stitching may be controlled to form either cut pile or loop pile, this apparatus, because of the backdrawing, produces uncut loops having a pile height shorter than the cut pile produced.

In Card et al U.S. Pat. No. 3,919,953 a tufting machine is disclosed in which adjacent rows of loopers point in the opposite direction to each other to form alternate rows of cut pile and loop pile. The rows of loopers which produce loop pile point in the same direction in which the base fabric is being fed, while the hooks in the rows producing cut pile point in the opposite direction and cooperate with a respective knife. Thus, although mounted in a single tufting machine bed, the loop pile producing members and the cut pile producing members operate in conventional manner and can be positioned below the bedplate to produce even level cut and loop pile. The difficulty presented, however, is that two looper bars are required, one slotted for the loop pile loopers and the other for the cut pile loopers. Thus, if a fabric having anything but a row of cut pile intermediate each row of loop pile is desired, it cannot be produced by this apparatus.

In Jolley et al U.S. Pat. No. 4,134,347 and Inman U.S. Pat. No. 4,185,569 tufting machines are illustrated in which level cut pile and loop pile may be formed in the same row of stitching selectively, and thus each row may form either cut pile or loop pile. These machines utilize gate controlled loopers for selectively opening and closing passage of a loop onto the blade of the looper, and although they provide versatile patterning capabilities their sophistication may not be warranted where the type of pile in a given row remains basically fixed.

SUMMARY OF THE INVENTION

Consequently, it is a primary object of the present invention to provide tufting apparatus for forming selective rows of loop pile stitching and cut pile stitching in a conventional cut pile tufting machine.

It is another object of the present invention to provide a looper for forming loop pile in a cut pile tufting machine where the base fabric is fed in the direction opposite to which the loopers point.

It is a further object of the present invention to provide in a cut pile tufting machine novel loopers in selective rows for producing loop pile in those rows, and which loopers can be sized to provide pile level with, greater than or less than the cut pile produced in the other rows.

The present invention provides a looper of a unique design for seizing a loop of yarn and for releasing the loop when pointing oppositely to the direction in which the loop is being moved by the base fabric. The looper is structured to insure that the loop is seized and then released so as not to be speared as the looper moves to seize the next loop. When mounted in a cut pile tufting machine the loopers form loop pile. Thus, any selective array of loop pile and cut pile rows may be produced inexpensively merely by replacing the conventional cut pile loopers with the special looper, no replacement of the cut pile looper mounting bars being necessary.

In practicing the principles of the present invention the looper includes a beak having a slightly downwardly inclined, rearwardly extending lower front edge from which a yarn contacting edge extends abruptly downwardly terminating at a bottom edge extending rearwardly toward the shank, the upper portion of the beak conventionally extending upwardly and rearwardly so that the looper is a closed body with only the yarn contacting edge and the beak engaging a loop. The body is substantially planar with a recess formed in one side for clearance with respect to the bulge at the eye of a needle.

BRIEF DESCRIPTION OF THE DRAWINGS

The particular features and advantages of the invention will become apparent from the following description taken in connection with the accompanying drawings, in which.

DESCRIPTION OF THE PREFERRED EMBODIMENT

Figure 1:
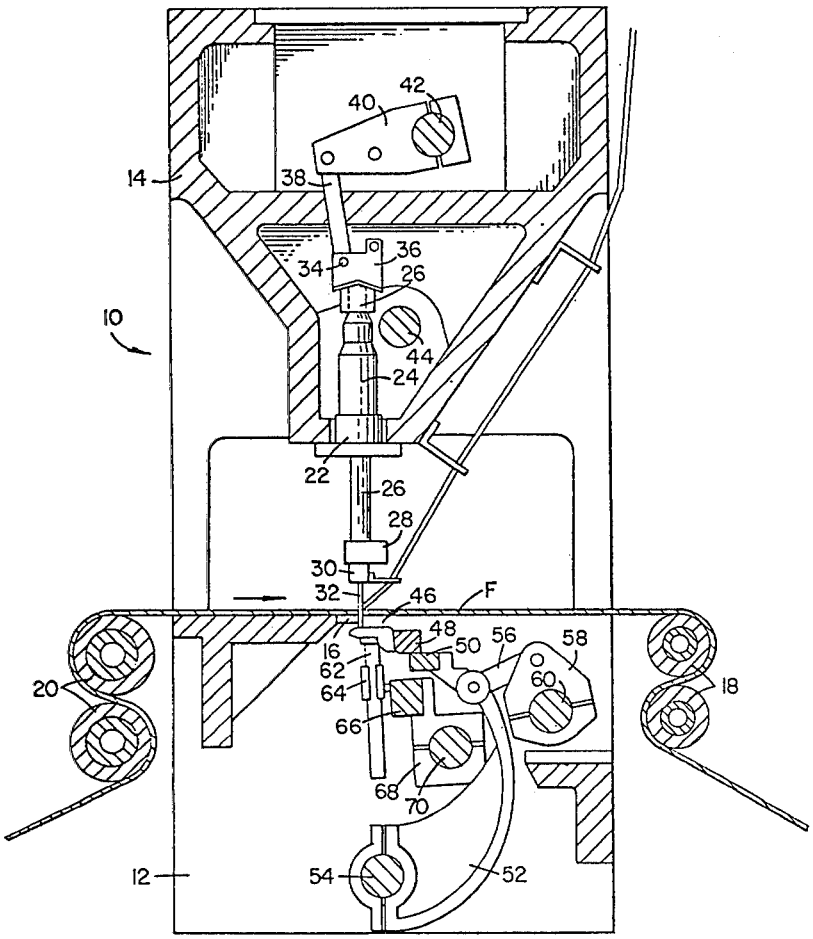
FIG. 1 is a vertical cross sectional view taken transversely through a cut pile tufting machine incorporating loopers constructed in accordance with the present invention disposed intermediate conventional cut pile loopers for forming alternate rows of cut pile and loop pile fabric.

Referring now to the drawings, there is illustrated in FIG. 1 a conventional cut pile tufting machine 10 having a frame comprising a bed 12 and a head 14 disposed above the bed. The bed 12 includes a bedplate 16 across which a backing fabric F is adapted to be fed by a pair of feed rolls 18 and take-off rolls 20.

Mounted in the head 14 are a plurality of collars 22 (only one of which is shown) for supporting a respective sleeve 24. Reciprocably mounted within each sleeve is a push rod 26, to the lower end of which a needle bar carrier 28 is attached and which in turn supports the needle bar 30 that carries a multiplicity of needles 32. The upper end of the push rod 26 is connected by a wrist pin 34 to a connecting member 36 which in turn is connected by a link 38 to a rock arm 40 on a rock shaft 42. Rocking motion is supplied to the shaft 42 by conventional means such as from a cam shaft 44 as is notoriously well known in the art. Briefly, however a circular cam is eccentrically fixed to the shaft 44 and drives a lever fixed to the shaft 42 through a connecting rod. Rotational motion of the shaft 44 is thus converted into rocking motion at shaft 42 to reciprocate the push rods 26, the needle bar 30 and the needles 32.

Mounted in the bed 12 for cooperation with the needles to seize loops of yarn presented thereby are a plurality of loopers or hooks generally indicated at 46 and comprising conventional cut pile hooks intermediate the novel loopers, all of which point in the direction oppositely to the direction in which the fabric F is fed and to which further reference will be made. For clarity of presentation, although the terms hooks and loopers are used inter-changeably, loopers herein refer to the loop pile loop seizing members and hooks refer to the cut pile loop seizing members. All the hooks and loopers however have conventional planar shanks or mounting portions positioned in slots in a hook or looper bar 48 carried by a mounting bar 50 secured to the upper end of a rocker arm 52. Conventionally the rocker arm 52 may be oscillated by a rock shaft 54 clamped at the lower end of the arm and journalled in the bed. Pivotably connected to the upper portion of the rocker arm is one end of a connecting link 56 having its other end pivotably connected between forked arms of a jack shaft rocker arm 58 which in turn is clamped to a jack shaft 60 oscillated by conventional drive means from the shaft 44 in timed relationship with the reciprocation of the needles.

A plurality of knives 62 respectively cooperate with each of the cut pile hooks to cut the loops seized thereon to form cut pile. The knives are mounted in knife blocks 64 secured to a knife bar 66 which in turn is secured to a knife shaft rocker arm 68 clamped to a rocking knife shaft 70. Oscillatory movement is imparted to the knife shaft 72 to conventionally drive the knives into engagement with one side of the respective cut pile hooks to provide a scissors-like cutting action to cut the loops thereon.

Figure 2:
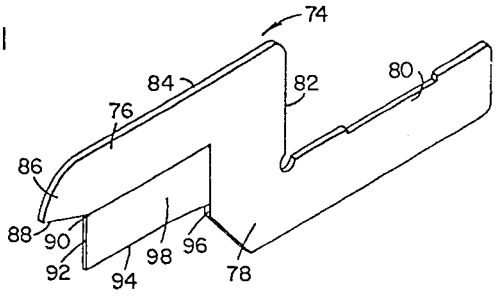
FIG. 2 is a perspective view of a looper constructed in accordance with the invention.
Figure 3:
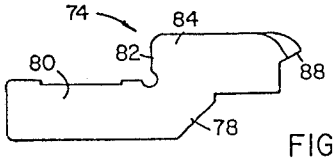
FIG. 3 is a side view illustrating the opposite side of the looper shown in FIG. 2.

Referring now to FIGS. 2 and 3, the loop pile looper 74 of the present invention comprises a planar member having a body portion including a blade 76 and a shank 78 having an elongated mounting portion 80 at the rear and which is positioned in the looper bar slot with the rear edge or neck 82 of the shank abutting the bar. The blade extends forwardly from the shank along edge 84 and terminates at its upper leading edge in a beak 86. The lower edge 88 of the beak is inclined downwardly and rearwardly for seizing and shedding loops of yarn presented by a respective needle, the length of the edge 88 should thus be long enough to enter and seize a yarn loop, but should be short enough to shed the loop as the looper oscillates and retracts from the loop seizing position as the needle begins its next downward stroke and pulls the previously formed loop. The angular inclination of the edge 88 aids in allowing the loop to shed from the beak. At the rear of the edge 88 at point 90 the blade has an edge 92 that extends downwardly abruptly. This edge is substantially linear and disposed substantially normal to the top edge 84 and substantially parallel to the neck 82. The edge 92 engages the crotch of a loop presented by the needle as the beak enters the loop and keeps the loop from moving rearwardly toward the shank as it would on a cut pile hook, thus allowing the loop to be seized and then shed by the beak. The top of the eye of the needle penetrates the base fabric F down to a level intermediate the point 90 and the bottom extent of the edge 92. From this bottom extent the blade extends rearwardly at edge 94 toward the shank and terminates at the throat 96.

To provide a clearance for the needle eye which, as is well known in the art, is bulged relatively to the clearance above the eye, the blade behind the yarn engaging edge 92 is recessed at 98. Thus, when the beak enters within the clearance above the eye the bulge at the eye enters the recess 98. It is proposed that this recess will be formed by hollow grinding the blade as illustrated, but that the recess need only be in the area between edges 92 and 94 and a line drawn rearwardly from point 90 to a line drawn along the throat 96.

Figure 4:
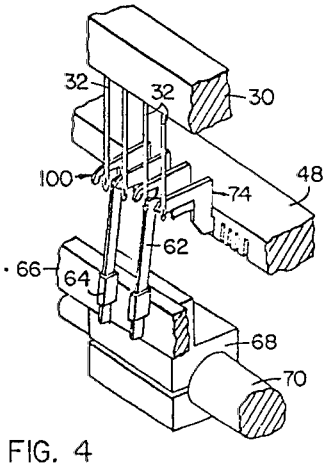
FIG. 4 is a perspective view of the stitch forming instrumentalities of a small fragment of the tufting machine illustrated in FIG. 1 for producing alternate rows of cut pile and loop pile.

Referring now to FIG. 4, each looper 74 is mounted in the looper bar in a pre-selected array with conventional cut pile hooks 100 and knives 62. As illustrated, there is a conventional cut pile hook 100 intermediate each novel loop pile looper 74, so that alternate rows of cut pile and loop pile may be formed. Separate yarn feed systems are supplied for the loopers and for the hooks and by sizing the loopers and positioning the beaks relatively to the cutting edges of the cut pile hook, level cut and loop pile can be produced similar to that produced by the apparatus in the aforesaid U.S. Pat. No. 3,919,953. However, the present apparatus is more versatile since the array of hooks and loopers can be conveniently and rapidly varied. Thus, if desired two or more loopers may be positioned between each pair of hooks and vice versa, the possibilities being almost boundless. Moreover, by sizing the loopers and positioning the beaks relatively to the cutting edge of the hooks, the pile height of the loop pile can be made equal to, longer or shorter than the cut pile. These variations, it should be understood, may be made quickly between carpet runs merely by removing and replacing the loopers with hooks or vice versa.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A looper for forming loop pile in a cut pile tufting machine, said looper comprising a planar body member having a blade and a shank including a mounting portion for mounting in a hook bar of the tufting machine, said blade extending forwardly from the shank and terminating at an upper edge in a loop seizing beak, said beak having a downwardly inclined rearwardly extending lower edge for seizing a loop of yarn, a yarn engaging edge formed on said blade extending abruptly downwardly from the rear of the lower edge of said beak, said blade having a bottom edge extending forwardly from said shank to said yarn engaging edge.

2. A looper as recited in claim 1 wherein one side of said blade includes a recess defining a clearance for cooperation with a needle in the tufting machine.

3. A looper as recited in claim 1 wherein said shank includes a substantially linear rear edge remote from said bill and said yarn engaging edge comprises a substantially linear edge substantially parallel to said rear edge.

4. In a tufting machine, means for feeding a base fabric in one direction, a yarn carrying needle for penetrating the base fabric and forming loops therein, a looper disposed on the opposite side of the base fabric from said needle for seizing said loops, said looper comprising a planar body member having a blade and a shank, said blade extending forwardly from the shank and terminating at an upper edge in a loop seizing beak, means for mounting said shank with said beak facing in a direction opposite to said one direction for oscillatory movement toward and away from said needle so that said beak enters successive loops, said beak having a downwardly inclined rearwardly extending lower edge for seizing a loop of yarn, a yarn engaging edge formed on said blade extending abruptly downwardly from the rear of the lower edge of said beak, said blade having a bottom edge extending forwardly from said shank to said yarn engaging edge.

5. In a tufting machine as recited in claim 4 including a second yarn carrying needle disposed adjacent said first mentioned needle for penetrating the base fabric and a hook disposed on the opposite side of said base fabric from said second needle for seizing loops of yarn presented by said second needle, said hook comprising a body portion including a blade and a loop seizing needle extending from said blade facing in a direction opposite to said one direction, means for mounting said body portion for oscillatory movement with said looper toward and away from said second needle so that said hook enters successive loops, the feeding of the fabric moving the loops toward the body portion, and a knife cooperating with the blade of said hook for severing loops thereon.

* * * * *